US006401469B1

(12) United States Patent
Dennis et al.

(10) Patent No.: US 6,401,469 B1
(45) Date of Patent: Jun. 11, 2002

(54) CONTROL UNIT AND METHOD FOR TWO-STAGE RECIPROCATING COMPRESSOR

(75) Inventors: Richard D. Dennis, Marcellus; Stephen C. Pederson, Marietta, both of NY (US)

(73) Assignee: Carrier Corporation, Farmington, CT (US)

( * ) Notice: Subject to any disclaimer, the term of this patent is extended or adjusted under 35 U.S.C. 154(b) by 0 days.

(21) Appl. No.: 09/952,605

(22) Filed: Sep. 14, 2001

(51) Int. Cl.[7] ..... F25B 7/00; F25B 1/00

(52) U.S. Cl. ..... 62/175; 62/229; 62/196.1

(58) Field of Search ..... 62/175, 229, 196.1, 62/196.2, 196.3, 228.1

(56) References Cited

U.S. PATENT DOCUMENTS 4,966,010 A * 10/1990 Jaster et al. ..... 62/179
5,257,508 A * 11/1993 Powell et al. ..... 62/180
6,044,652 A * 4/2000 Nishihara et al. ..... 62/175

FOREIGN PATENT DOCUMENTS

WO 99/09319 2/1999

* cited by examiner

*Primary Examiner*—Denise L. Esquivel
*Assistant Examiner*—Marc Norman
(74) *Attorney, Agent, or Firm*—Wall Marjama & Bilinski LLP

(57) ABSTRACT

A two stage compressor which provides a high capacity stage and a low capacity stage is used with multiple evaporator condensing units. A control system for controlling the compressor receives inputs from two indoor locations via thermostats. The compressor runs in the low capacity stage when cooling is called for from only one of the thermostats, but runs in the high capacity stage when cooling is called for from both of the thermostats. The control system controls the transition of the compressor from the low capacity stage to the high capacity stage, and from the high capacity stage to the low capacity stage.

10 Claims, 5 Drawing Sheets

Y1
ON
OFF

Y2
OFF

K2
HIGH
LOW

K1
ON
OFF

K3
ON
OFF

ML
ON
OFF

MH
ON
OFF
2 SEC
5 SEC

Y1
ON
OFF

Y2
OFF

K2
HIGH
LOW

K1
ON
OFF

K3
ON
OFF

ML
ON
OFF

MH
ON
OFF
2 SEC
5 SEC

Y1
ON
OFF

Y2
OFF

K2
HIGH
LOW

K1
ON
OFF

K3
ON
OFF

ML
ON
OFF

MH
ON
OFF

2 SEC
5 SEC

Y1
ON
OFF

Y2
OFF

K2
HIGH
LOW

K1
ON
OFF

K3
ON
OFF

ML
ON
OFF

MH
ON
OFF
2 SEC
5 SEC

CONTROL UNIT AND METHOD FOR TWO-STAGE RECIPROCATING COMPRESSOR

FIELD OF THE INVENTION

This invention relates generally to the field of control units and methods for controlling condensing units, and more particularly to a multi-split control unit for a condensing unit having a two-stage reciprocating compressor.

BACKGROUND OF THE INVENTION

A multi-split condensing unit, such as the 38HDS Multi-Split Condensing Unit made by Carrier Corp., serves two zones, allowing many indoor fan coil combinations. A multi-split application uses separate fan coils to cool separate spaces. This unit uses a fixed speed compressor and oversized fan coils, along with a head pressure control, to be able to run either two fan coils together or just one fan coil alone. The head pressure control is unwieldy and complicated.

A two speed (two-stage) compressor would fit a multi-split application better than a variable speed compressor or a fixed speed multi-evaporator system. A control system for a two stage compressor needs to handle multiple thermostat inputs and control the various stages to deliver the proper amount of cooling in an efficient manner.

SUMMARY OF THE INVENTION

Briefly stated, a two stage compressor which provides a high capacity stage and a low capacity stage is used with multiple evaporator condensing units. A control system for controlling the compressor receives inputs from two indoor locations via thermostats. The compressor runs in the low capacity stage when cooling is called for from only one of the thermostats, but runs in the high capacity stage when cooling is called for from both of the thermostats. The control system controls the transition of the compressor from the low capacity stage to the high capacity stage, and from the high capacity stage to the low capacity stage.

According to an embodiment of the invention, a control system for controlling a two stage compressor used with multiple evaporator condensing units, wherein the two stage compressor includes a low capacity stage and a high capacity stage, includes means for receiving input from first and second thermostats; means for controlling the compressor such that the compressor runs in the low capacity stage when cooling is called for from only one of the first and second thermostats, the high capacity stage when cooling is called for from both first and second thermostats simultaneously, and is off when no call for cooling is received from either first or second thermostats; means for transitioning the compressor from the low capacity stage to the high capacity stage; and means for transitioning the compressor from the high capacity stage to the low capacity stage.

According to an embodiment of the invention, a method for controlling a two stage compressor used with multiple evaporator condensing units, wherein the two stage compressor includes a low capacity stage and a high capacity stage, includes the steps of (a) receiving input from first and second thermostats; (b) controlling the compressor such that the compressor runs in the low capacity stage when cooling is called for from only one of the first and second thermostats, the high capacity stage when cooling is called for from both first and second thermostats simultaneously, and is off when no call for cooling is received from either first or second thermostats; (c) transitioning the compressor from the low capacity stage to the high capacity stage;

and (d) transitioning the compressor from the high capacity stage to the low capacity stage.

DETAILED DESCRIPTION OF THE PREFERRED EMBODIMENT

A compressor preferably used for a multi-split condensing unit is a two-stage reciprocating compressor made by Bristol Compressors, Inc., and described in U.S. Pat. No. 6,092,993 issued on Jul. 25, 2000, incorporated herein by reference. A problem with this compressor is that due its unique design, it changes speeds by reversing the direction of the crankshaft in the reciprocating compressor. Forward is high speed because it drives both pistons, while reverse is low speed because it only drives one piston. When only one thermostat calls for cooling, low speed is used. When both thermostats call for cooling, high speed is used. A control unit for this compressor in a multi-split application must integrate the high and low speed demands from the thermostats with the two-speed forward and reverse operation of the reciprocating compressor.

Figure 1:
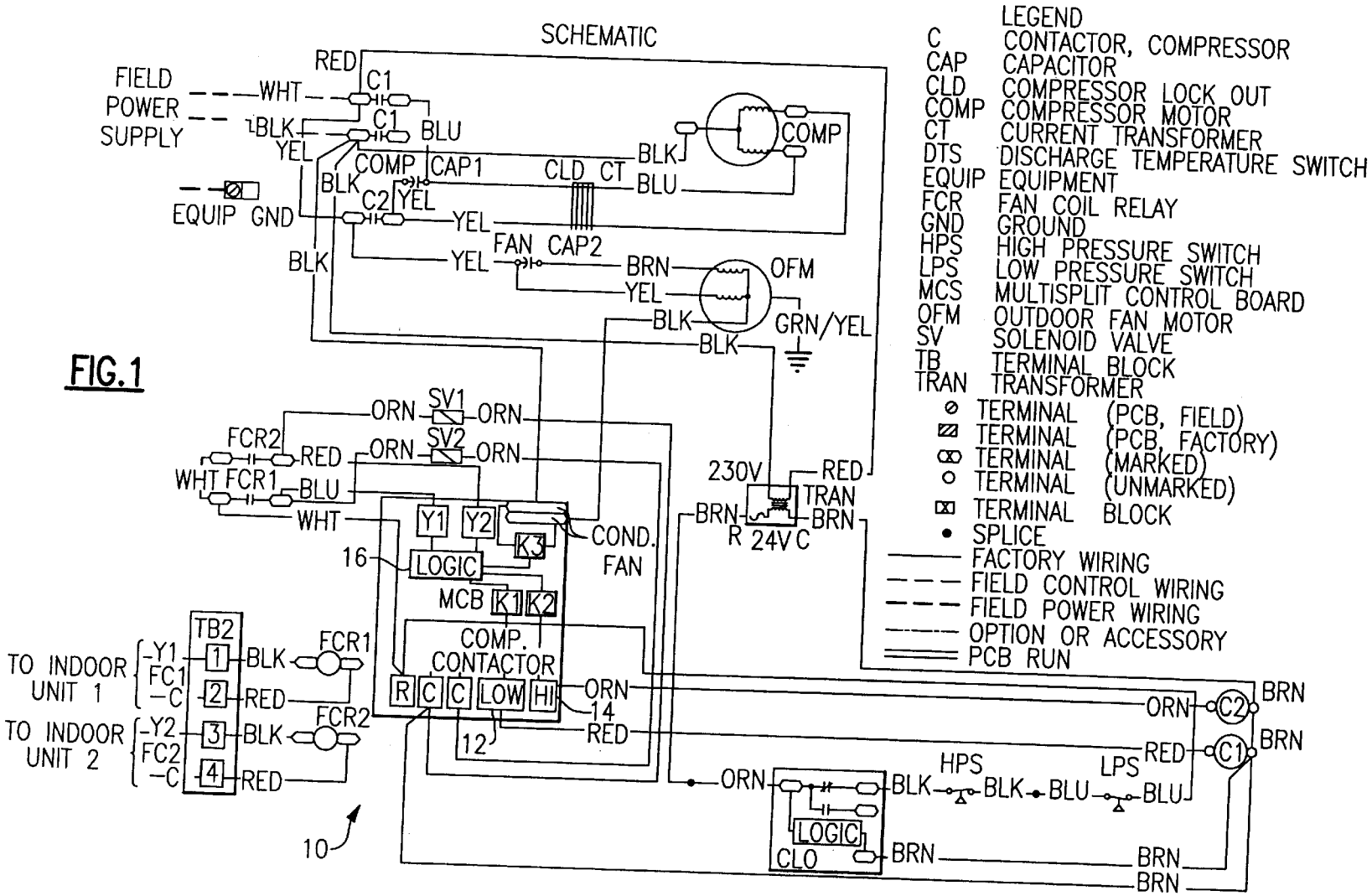
FIG. 1 shows a control circuit for a two-stage reciprocating compressor used for a multisplit application according to an embodiment of the invention.

Referring to FIG. 1, a two-stage compressor (not shown) is controlled by a circuit 10. A compressor operation relay K1, via a terminal 12, provides a 24 VAC signal to energize an external contactor which starts the compressor motor in the direction which enables the compressor in the low capacity stage. This signal is labeled ML in the timing diagrams of FIGS. 2F, 3F, 4F, and 5F. A configuration relay K2, via a terminal 14, provides a 24 VAC signal to energize an external contactor which starts the compressor motor in the direction which enables the compressor in the high capacity stage. This signal is labeled MH in the timing diagrams of FIGS. 2G, 3G, 4G, and 5G. An outdoor fan relay K3 energizes an outdoor fan motor, i.e., the condenser fan. Relays K1, K2, and K3, as well as thermostat inputs Y1 and Y2 from the areas being cooled, are controlled by a logic unit 16 on the multi-split control board (MCB). For this embodiment, Y1 refers to the first thermostat signal while Y2 refers to the second thermostat signal. Either Y1 or Y2 by itself enables the air conditioner's low capacity stage. A Y1 AND Y2 signal initiates operation in the high capacity stage.

The Y1 and Y2 inputs are 24 VAC signals preferably derived from the 24 VAC control transformers. The control input preferably has an input threshold such that an input current in excess of 5 mA. is required for an input signal to be detected by logic unit 16. This requirement is necessary to provide operational compatibility with "power stealing" thermostats.

The operational sequence for a call for cooling is as follows. The indoor unit sends a 24V signal on Y1 or Y2 (thermostat inputs) to call for operation of the corresponding indoor unit. This independently energizes a fan coil relay for each fan coil, allowing a 24V signal from the multisplit control (preferably powered by the outdoor unit transformer) to return to the control and acknowledge the cooling call. The multisplit control then opens the correct solenoid valve for that fan coil and turns on the corresponding compressor for that refrigeration circuit after a time delay, preferably three minutes. The time delay is the anti-short cycle delay (ASCD) that conventionally keeps compressors from cycling on and off too quickly. If the high pressure switch (HPS) and low pressure switch (LPS) are closed, the compressor will run. The HPS and LPS are conventional safety devices that keep the pressures in the system from being too high or too low. If the HPS or the LPS are open, the 24V to the contactor coil is interrupted and the compressor lock-out (CLO) keeps the circuit open until reset by stopping and restarting the 24V power at the thermostat.

Figures 2A, 2B, 2C, 2D, 2E, 2F, 2G:
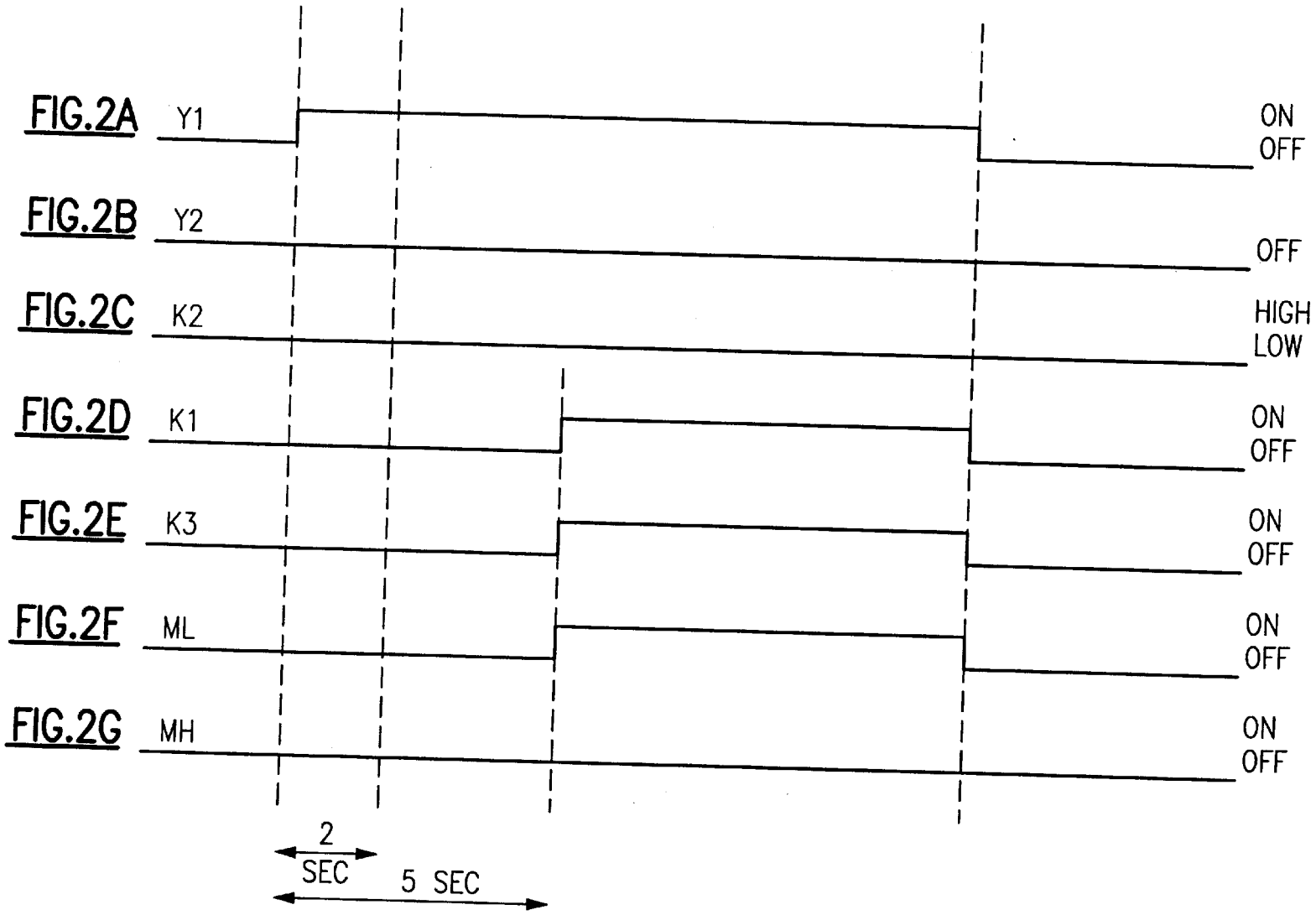
FIG. 2A shows part of a timing diagram used in explaining the operation of an embodiment of the invention.
FIG. 2B shows part of a timing diagram used in explaining the operation of an embodiment of the invention.
FIG. 2C shows part of a timing diagram used in explaining the operation of an embodiment of the invention.
FIG. 2D shows part of a timing diagram used in explaining the operation of an embodiment of the invention.
FIG. 2E shows part of a timing diagram used in explaining the operation of an embodiment of the invention.
FIG. 2F shows part of a timing diagram used in explaining the operation of an embodiment of the invention.
FIG. 2G shows part of a timing diagram used in explaining the operation of an embodiment of the invention.

Referring to FIGS. 2A–2G, the timing for a call for operation from a single indoor unit is shown. This operation initiates one-cylinder operation for the compressor. When a call for cooling operation is received from either indoor unit Y1 or Y2, 2 second and 5 second timers are preferably initiated. The 2-second timer is for an "ignore" period which minimizes transient mode changes of thermostat inputs Y1 and Y2, and is preferably two seconds, but can be set for other times. This particular compressor (Bristol) requires a preferable 5 second delay to change speeds; other delay periods are possible with other compressors. In this example, Y1 is shown going high in FIG. 2A. Upon expiration of the 2-second timer, configuration relay K2 is set for low capacity operation if not already set for low capacity operation. Upon expiration of the 5-second timer, compressor operation relay K1 is energized (FIG. 2D), compressor low capacity contactor ML is energized (FIG. 2F), and outdoor fan relay K3 is energized (FIG. 2E).

Figures 3A, 3B, 3C, 3D, 3E, 3F, 3G:
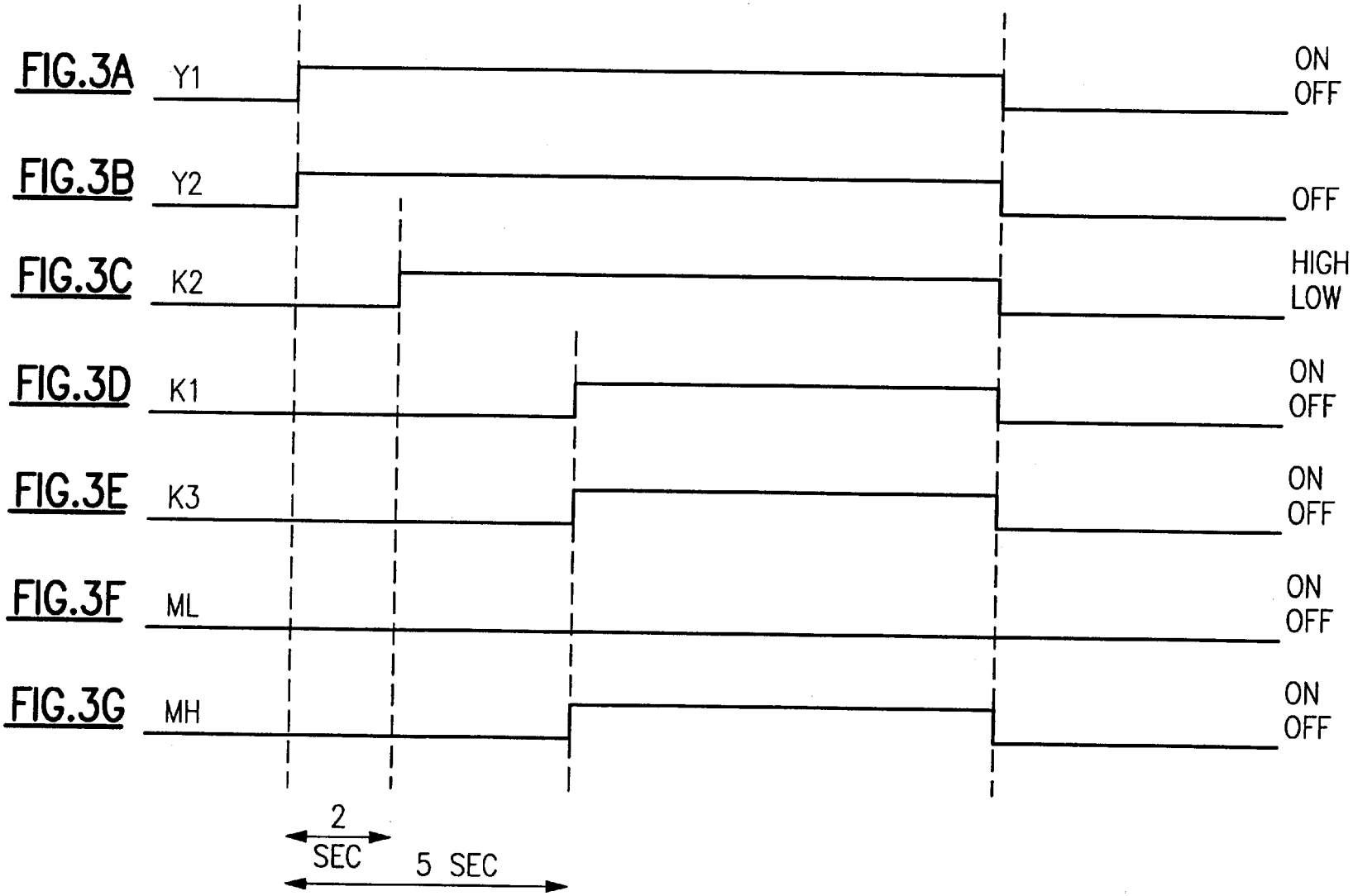
FIG. 3A shows part of a timing diagram used in explaining the operation of an embodiment of the invention.
FIG. 3B shows part of a timing diagram used in explaining the operation of an embodiment of the invention.
FIG. 3C shows part of a timing diagram used in explaining the operation of an embodiment of the invention.
FIG. 3D shows part of a timing diagram used in explaining the operation of an embodiment of the invention.
FIG. 3E shows part of a timing diagram used in explaining the operation of an embodiment of the invention.
FIG. 3F shows part of a timing diagram used in explaining the operation of an embodiment of the invention.
FIG. 3G shows part of a timing diagram used in explaining the operation of an embodiment of the invention.

Referring to FIGS. 3A–3G, the timing for a call for cooling operation is received from both indoor units, i.e., two-cylinder operation, is shown. When Y1 and Y2 both go high, 2-second and 5-second timers are initiated (FIGS. 3A–3B). Upon expiration of the 2-second timer, configuration relay K2 is set for high capacity operation (FIG. 3C). Upon expiration of the 5-second timer, compressor operation relay K1 is energized (FIG. 3D), compressor high capacity contactor MH is energized (FIG. 3G), and outdoor fan relay K3 is energized (FIG. 3E).

Figures 4A, 4B, 4C, 4D, 4E, 4F, 4G:
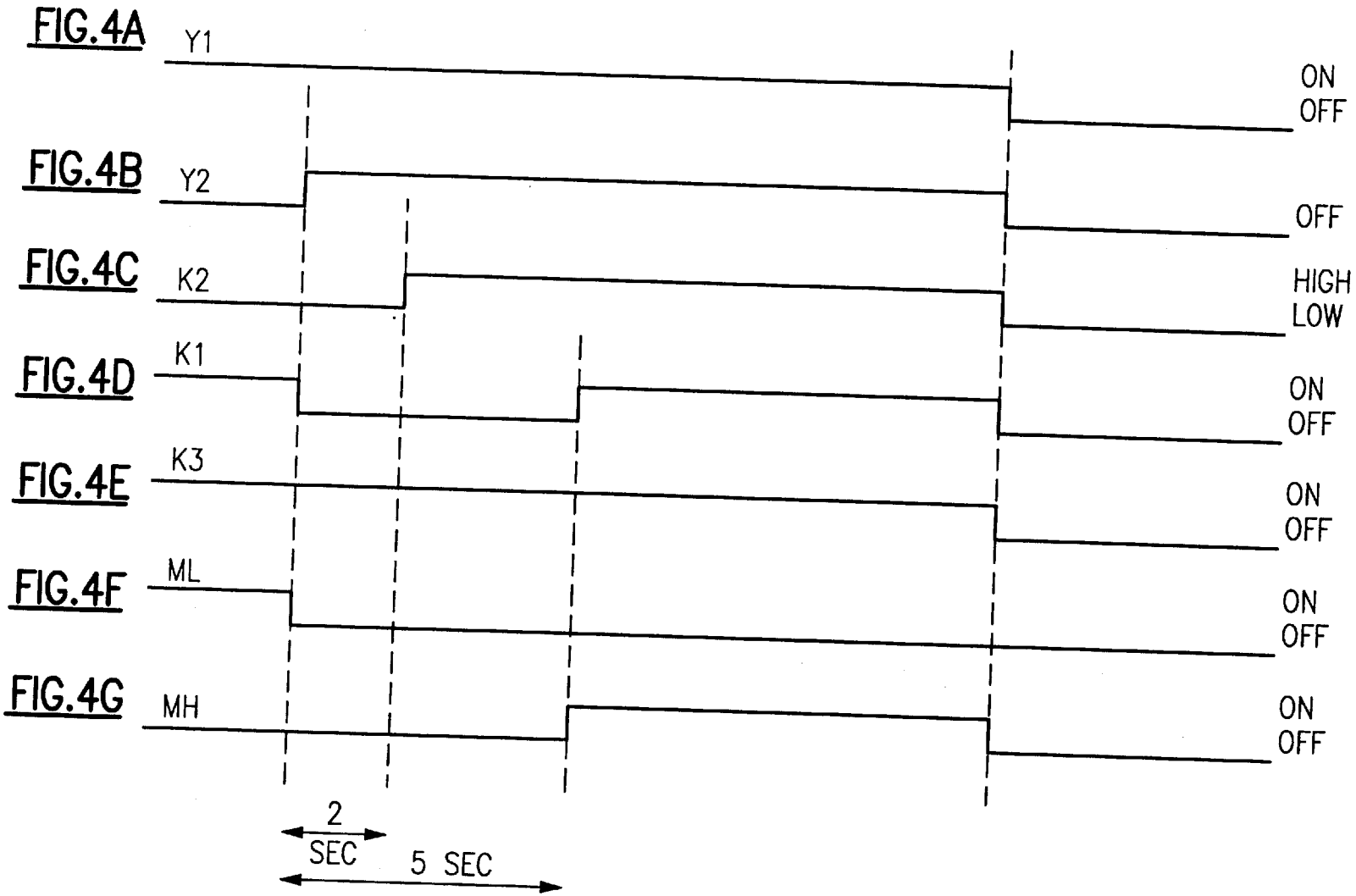
FIG. 4A shows part of a timing diagram used in explaining the operation of an embodiment of the invention.
FIG. 4B shows part of a timing diagram used in explaining the operation of an embodiment of the invention.
FIG. 4C shows part of a timing diagram used in explaining the operation of an embodiment of the invention.
FIG. 4D shows part of a timing diagram used in explaining the operation of an embodiment of the invention.
FIG. 4E shows part of a timing diagram used in explaining the operation of an embodiment of the invention.
FIG. 4F shows part of a timing diagram used in explaining the operation of an embodiment of the invention.
FIG. 4G shows part of a timing diagram used in explaining the operation of an embodiment of the invention.
Figures 5A, 5B, 5C, 5D, 5E, 5F, 5G:
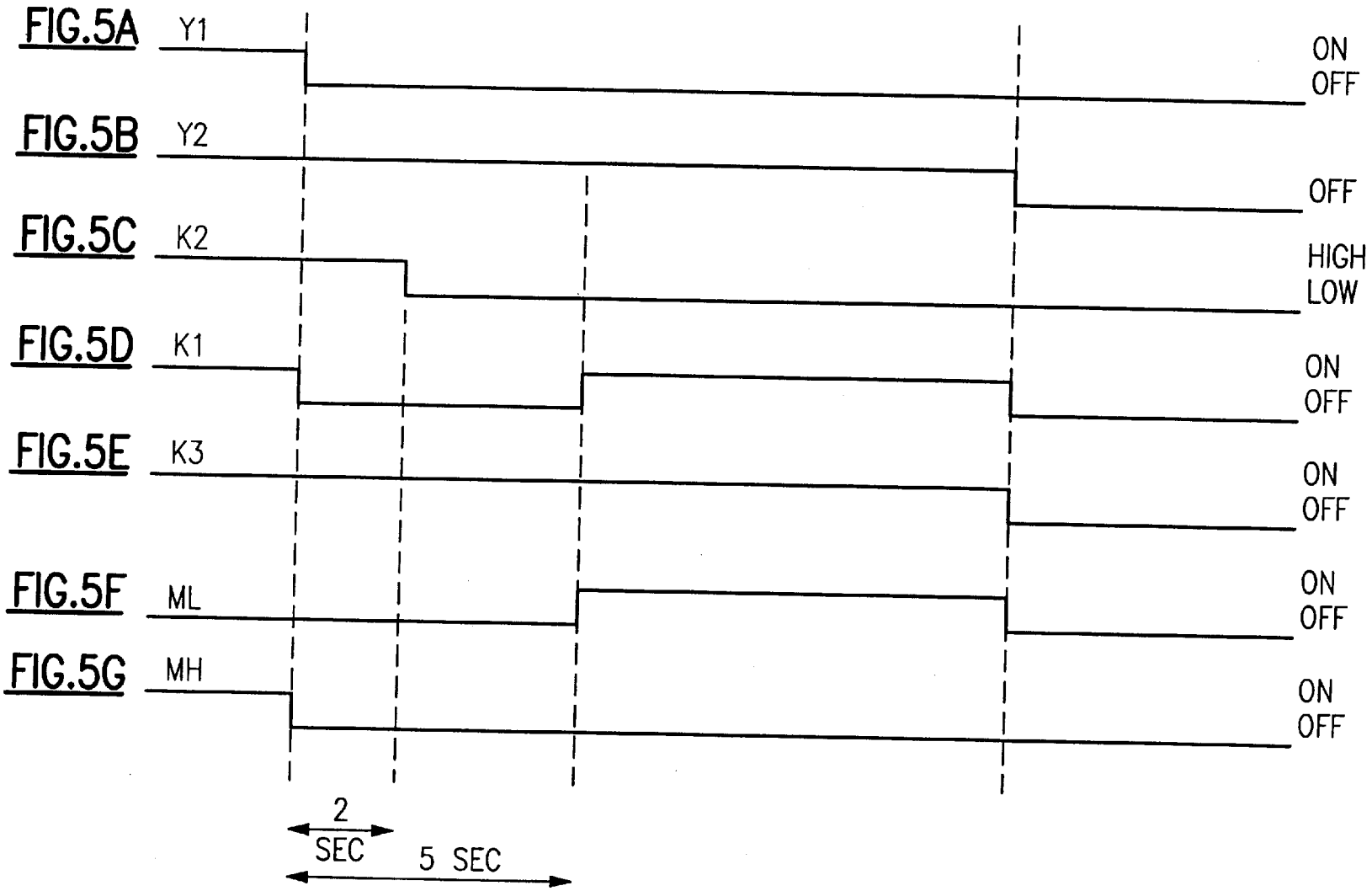
FIG. 5A shows part of a timing diagram used in explaining the operation of an embodiment of the invention.
FIG. 5B shows part of a timing diagram used in explaining the operation of an embodiment of the invention.
FIG. 5C shows part of a timing diagram used in explaining the operation of an embodiment of the invention.
FIG. 5D shows part of a timing diagram used in explaining the operation of an embodiment of the invention.
FIG. 5E shows part of a timing diagram used in explaining the operation of an embodiment of the invention.
FIG. 5F shows part of a timing diagram used in explaining the operation of an embodiment of the invention.
FIG. 5G shows part of a timing diagram used in explaining the operation of an embodiment of the invention.

Referring to FIGS. 4A–4G, the transition from a single indoor unit to two indoor units is shown. When the system is already operating with one indoor unit active (FIG. 4A) and a call for cooling operation is received from the other indoor unit (FIG. 4B), 2-second and 5-second timers are initiated, and compressor operation relay K1 (FIG. 4D) and compressor low capacity contactor ML (FIG. 4F) are de-energized. Upon expiration of the 2-second timer, configuration relay K2 (FIG. 4C) is set for high capacity operation. Upon expiration of the 5-second timer, compressor operation relay K1 is energized (FIG. 4D), compressor high capacity contactor MH is energized (FIG. 4G), and outdoor fan relay K3 continues to be energized (FIG. 4E).

Referring to FIGS. 5A–5G, the timing for a transition from two indoor units to a single indoor unit is shown. When the system is already operating with two indoor units active (FIGS. 5A–5B) and the call for cooling operation from one indoor unit, for example, Y1 is satisfied (FIG. 5A), 2-second and 5-second timers are initiated and compressor operation relay K1 (FIG. 5D) and compressor high capacity contactor MH (FIG. 5G) are de-energized. Upon expiration of the 2-second timer, configuration relay K2 is set for low capacity operation. Upon expiration of the 5-second timer, compressor operation relay K1 is energized, compressor low capacity contactor ML is energized, and outdoor fan relay K3 continues to be energized.

While the present invention has been described with reference to a particular preferred embodiment and the accompanying drawings, it will be understood by those skilled in the art that the invention is not limited to the preferred embodiment and that various modifications and the like could be made thereto without departing from the scope of the invention as defined in the following claims.

What is claimed is:

1. A control system for controlling a two stage compressor used with multiple evaporator condensing units, wherein said two stage compressor includes a low capacity stage and a high capacity stage, comprising:

means for receiving input from first and second thermostats;

means for controlling said compressor such that said compressor runs in said low capacity stage when cooling is called for from only one of said first and second thermostats, said high capacity stage when cooling is called for from both first and second thermostats simultaneously, and is off when no call for cooling is received from either first or second thermostats;

first means for transitioning said compressor from said low capacity stage to said high capacity stage; and second means for transitioning said compressor from said high capacity stage to said low capacity stage.

2. A control system according to claim 1, wherein said two-stage compressor is a reciprocating compressor.

3. A control system according to claim 2, wherein said first means and said second means each include means for bringing said compressor to a stop between stages.

4. A control system according to claim 3, wherein a direction of rotation of said compressor determines when said compressor is in said high capacity stage and in said low capacity stage.

5. A control system according to claim 2, wherein a direction of rotation of said compressor determines when said compressor is in said high capacity stage and in said low capacity stage.

6. A method for controlling a two stage compressor used with multiple evaporator condensing units, wherein said two stage compressor includes a low capacity stage and a high capacity stage, comprising the steps of:

receiving input from first and second thermostats;

controlling said compressor such that said compressor runs in said low capacity stage when cooling is called for from only one of said first and second thermostats, said high capacity stage when cooling is called for from both first and second thermostats simultaneously, and is off when no call for cooling is received from either first or second thermostats;

transitioning said compressor from said low capacity stage to said high capacity stage; and transitioning said compressor from said high capacity stage to said low capacity stage.

7. A method according to claim 6, wherein said two-stage compressor is a reciprocating compressor.

8. A method according to claim 7, wherein said steps of transitioning said compressor each include bringing said compressor to a stop between stages.

9. A method according to claim 8, wherein a direction of rotation of said compressor determines when said compressor is in said high capacity stage and in said low capacity stage.

10. A method according to claim 7, wherein a direction of rotation of said compressor determines when said compressor is in said high capacity stage and in said low capacity stage.

* * * * *